US009375955B2

(12) United States Patent
Ishida et al.

(10) Patent No.: US 9,375,955 B2
(45) Date of Patent: Jun. 28, 2016

(54) PRINTING APPARATUS AND CONTROL METHOD

(71) Applicant: CANON KABUSHIKI KAISHA, Tokyo (JP)

(72) Inventors: Takaaki Ishida, Kawasaki (JP); Yuki Emoto, Tokyo (JP); Shuichi Tokuda, Kawasaki (JP); Toshirou Yoshiike, Kawasaki (JP); Tatsunori Shimonishi, Ebina (JP); Junichi Hirate, Kawasaki (JP); Kiyoshi Masuda, Kawasaki (JP); Tomoyuki Saito, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/017,131

(22) Filed: Sep. 3, 2013

(65) Prior Publication Data

US 2014/0078207 A1 Mar. 20, 2014

(30) Foreign Application Priority Data

Sep. 14, 2012 (JP) ..... 2012-203542

(51) Int. Cl.
*B41J 11/00* (2006.01)
*B41J 13/00* (2006.01)
(Continued)

(52) U.S. Cl.
CPC ..... *B41J 11/007* (2013.01); *B41J 11/42* (2013.01); *B41J 13/00* (2013.01); *B41J 13/0009* (2013.01); *B41J 13/0027* (2013.01); *B41J 13/02* (2013.01); *B41J 13/03* (2013.01)

(58) Field of Classification Search
CPC ..... B41J 2/155; B41J 11/007; B41J 11/42; B41J 13/03; B41J 13/02; B41J 13/00; B41J 13/0009; B41J 13/0027
See application file for complete search history.

(56) References Cited

U.S. PATENT DOCUMENTS 5,602,571 A 2/1997 Suda et al.
6,801,332 B1 10/2004 Suga
(Continued)

FOREIGN PATENT DOCUMENTS

CN 101096156 A 1/2008
CN 101844689 A 9/2010
(Continued)

OTHER PUBLICATIONS

U.S. Appl. No. 14/017,125, filed Sep. 3, 2013 Applicant: Yuki Emoto.
(Continued)

*Primary Examiner* — Justin Seo
(74) *Attorney, Agent, or Firm* — Fitzpatrick, Cella, Harper & Scinto

(57) ABSTRACT

A printing apparatus includes a printing unit, a first and second conveying units conveying a printing medium, a driving unit driving the conveying units and a control unit controlling the driving unit. A load mutually acting on the conveying units through the medium in a conveyance state by the conveying units is recursively calculated for each predetermined conveyance unit while setting the initial value to 0. The driving unit is controlled based on the calculation result at the time of the transition to suppress a fluctuation in a conveyance amount at the time of the transition of the conveyance state of the medium from the conveyance state by the conveying units to a conveyance state only by the second conveying unit.

12 Claims, 16 Drawing Sheets

(51) Int. Cl.

| | |
|---|---|
| ***B41J 13/02*** | (2006.01) |
| ***B41J 13/03*** | (2006.01) |
| ***B41J 11/42*** | (2006.01) |

(56) References Cited

U.S. PATENT DOCUMENTS

| | | | | |
|---|---|---|---|---|
| 6,827,421 | B2 | 12/2004 | Nunokawa et al. | |
| 7,095,521 | B2 | 8/2006 | Yoshida | |
| 7,744,186 | B2 | 6/2010 | Yoshida et al. | |
| 8,235,492 | B2 | 8/2012 | Saito et al. | |
| 8,328,320 | B2 | 12/2012 | Nakata | |
| 2004/0080568 | A1 * | 4/2004 | Matsuo ..... | B41J 2/14233 347/40 |
| 2004/0109037 | A1 | 6/2004 | Nunokawa et al. | |
| 2007/0126837 | A1 | 6/2007 | Takahashi et al. | |
| 2008/0073832 | A1 | 3/2008 | Sudo et al. | |
| 2010/0045725 | A1 | 2/2010 | Saito et al. | |
| 2012/0086968 | A1 | 4/2012 | Saito | |

FOREIGN PATENT DOCUMENTS

| | | | |
|---|---|---|---|
| JP | 4-148958 | A | 5/1992 |
| JP | 2004-9686 | A | 1/2004 |
| JP | 2010-46994 | A | 4/2010 |

OTHER PUBLICATIONS

Chinese Office Action dated May 6, 2015 issued in corresponding Chinese Patent Application No. 201310421591.5.

* cited by examiner

FIG. 5

| | PHASE INTERVAL CONVEYANCE AMOUNT D | |
|---|---|---|
| | FIRST CONVEYANCE STATE (CONVEYANCE BY MAIN CONVEYANCE ROLLER) | THIRD CONVEYANCE STATE (CONVEYANCE BY DISCHARGE ROLLER) |
| S1 | $D_{LF1}$ | $D_{EJ1}$ |
| S2 | $D_{LF2}$ | $D_{EJ2}$ |
| S3 | $D_{LF3}$ | $D_{EJ3}$ |
| S4 | $D_{LF4}$ | $D_{EJ4}$ |
| S5 | $D_{LF5}$ | $D_{EJ5}$ |
| S6 | $D_{LF6}$ | $D_{EJ6}$ |
| S7 | $D_{LF7}$ | $D_{EJ7}$ |
| S8 | $D_{LF8}$ | $D_{EJ8}$ |

LStart
LEnd
P
80
2
3
6
7
ϕStart
ϕStart_sns
ϕEnd
ϕEnd_sns

FIG. 9

| ROTATION PHASE POSITION | CONVEYANCE POSITION n | PHASE SECTION | INPUT | | OUTPUT |
|---|---|---|---|---|---|
| | | | $D_{LFm}$ | $D_{EJm}$ | Fn |
| ϕStart | 1 | S6 | $D_{LF6}$ | $D_{EJ6}$ | $F_1=0$ |
| | 2 | S7 | $D_{LF7}$ | $D_{EJ7}$ | $F_2$ |
| | 3 | S8 | $D_{LF8}$ | $D_{EJ8}$ | $F_3$ |
| | 4 | S1 | $D_{LF1}$ | $D_{EJ1}$ | $F_4$ |
| | 5 | S2 | $D_{LF2}$ | $D_{EJ2}$ | $F_5$ |
| | 6 | S3 | $D_{LF3}$ | $D_{EJ3}$ | $F_6$ |
| | 7 | S4 | $D_{LF4}$ | $D_{EJ4}$ | $F_7$ |
| | 8 | S5 | $D_{LF5}$ | $D_{EJ5}$ | $F_8$ |
| | 9 | S6 | $D_{LF6}$ | $D_{EJ6}$ | $F_9$ |
| | 10 | S7 | $D_{LF7}$ | $D_{EJ7}$ | $F_{10}$ |
| | 11 | S8 | $D_{LF8}$ | $D_{EJ8}$ | $F_{11}$ |
| | 12 | S1 | $D_{LF1}$ | $D_{EJ1}$ | $F_{12}$ |
| | ・ | | ・ | ・ | |
| | ・ | | ・ | ・ | |
| | ・ | | ・ | ・ | |
| ϕEnd | a | S5 | $D_{LF5}$ | $D_{EJ5}$ | Fa |

FIG. 12

| ROTATION PHASE POSITION | CONVEYANCE POSITION n | PHASE SECTION | INPUT | | OUTPUT |
|---|---|---|---|---|---|
| | | | $D_{LFm}$ | $D_{EJm}$ | Fn |
| ϕStart | 1 | S6 | $D_{LF6}$ | $D_{EJ6}$ | |
| | 2 | S7 | $D_{LF7}$ | $D_{EJ7}$ | |
| | 3 | S8 | $D_{LF8}$ | $D_{EJ8}$ | |
| | 4 | S1 | $D_{LF1}$ | $D_{EJ1}$ | |
| | 5 | S2 | $D_{LF2}$ | $D_{EJ2}$ | |
| | 6 | S3 | $D_{LF3}$ | $D_{EJ3}$ | |
| | 7 | S4 | $D_{LF4}$ | $D_{EJ4}$ | |
| | 8 | S5 | $D_{LF5}$ | $D_{EJ5}$ | $F_1=0$ |
| | 9 | S6 | $D_{LF6}$ | $D_{EJ6}$ | $F_2$ |
| | 10 | S7 | $D_{LF7}$ | $D_{EJ7}$ | $F_3$ |
| | 11 | S8 | $D_{LF8}$ | $D_{EJ8}$ | $F_4$ |
| | 12 | S1 | $D_{LF1}$ | $D_{EJ1}$ | $F_5$ |
| | ・ | | ・ | ・ | |
| | ・ | | ・ | ・ | |
| | ・ | | ・ | ・ | |
| ϕEnd | a | S5 | $D_{LF5}$ | $D_{EJ5}$ | Fa' |

FIG. 14

| | PHASE INTERVAL CONVEYANCE AMOUNT D | |
|---|---|---|
| | FIRST CONVEYANCE STATE (CONVEYANCE BY MAIN CONVEYANCE ROLLER) | THIRD CONVEYANCE STATE (CONVEYANCE BY DISCHARGE ROLLER) |
| S1 | $D_{LF1}$ | $D_{EJ1}$ |
| S2 | $D_{LF2}$ | $D_{EJ2}$ |
| S3 | $D_{LF3}$ | $D_{EJ3}$ |
| S4 | $D_{LF4}$ | $D_{EJ4}$ |
| S5 | $D_{LF5}$ | $D_{EJ5}$ |
| S6 | $D_{LF6}$ | $D_{EJ6}$ |
| : | : | : |
| S2000 | $D_{LF2000}$ | $D_{EJ2000}$ |

FIG. 16

EQUATION 1

$$\beta_{LFEJ} = \beta_{LF} + \alpha_{LF} \cdot F_{LF}$$
$$\beta_{LFEJ} = \beta_{EJ} + \alpha_{EJ} \cdot F_{EJ}$$

EQUATION 2

$$F_{EJ} = \frac{\beta_{LF} - \beta_{EJ}}{\alpha_{LF} + \alpha_{EJ}}$$

EQUATION 3

$$X_{LF} = -(1/K_{LF}) \cdot \delta F_{LF}$$
$$X_{EJ} = -(1/K_{EJ}) \cdot \delta F_{EJ}$$

EQUATION 4

$$\beta_{LFEJ} = \beta_{LF} - \alpha_{LF} \cdot \frac{F_n + F_{n-1}}{2} + \frac{1}{K_{LF}} \cdot (F_n - F_{n-1})$$
$$\beta_{LFEJ} = \beta_{EJ} + \alpha_{EJ} \cdot \frac{F_n + F_{n-1}}{2} - \frac{1}{K_{EJ}} \cdot (F_n - F_{n-1})$$

EQUATION 5

$$F_n = \frac{(\beta_{LF} - \beta_{EJ}) - \{(\alpha_{LF} + \alpha_{EJ})/2 + (1/K_{LF} + 1/K_{EJ})\} F_{n-1}}{(\alpha_{LF} + \alpha_{EJ})/2 - (1/K_{LF} + 1/K_{EJ})}$$

EQUATION 6

$$F_n = \frac{(D_{LFm} - D_{EJm}) - \{(\alpha_{LF} + \alpha_{EJ})/2 + (1/K_{LF} + 1/K_{EJ})\} F_{n-1}}{(\alpha_{LF} + \alpha_{EJ})/2 - (1/K_{LF} + 1/K_{EJ})}$$

EQUATION 7

$$Z_{KICK} = F_a \cdot J$$

EQUATION 8

$$Z = Z_{FEED} + F_a \cdot J$$

EQUATION 9

$$\delta\theta = \frac{Z \cdot 2\pi}{L}$$

EQUATION 10

$$\delta t = \frac{Z}{V}$$

PRINTING APPARATUS AND CONTROL METHOD

BACKGROUND OF THE INVENTION

1. Field of the Invention

The present invention relates to a conveyance technique of a printing medium or the like.

2. Description of the Related Art

In recent years, a printing apparatus such as a copying machine or a printer is often used to print a photographic image. Especially, an inkjet printing apparatus can form an image of the same quality as a silver halide photo on the strength of reduction of the ink droplet size and improvement of image processing technologies.

Against the backdrop of the demand for higher image quality, a high accuracy is required to convey a printing medium. In particular, regarding a roller for conveying the printing medium, a very high accuracy is needed because the printing medium conveyance amount is almost proportional to the outer diameter of the roller. However, the accuracy of finishing of the roller is limited. Hence, there is a need of conveyance control capable of implementing a high conveyance accuracy regardless of a variation in the outer diameter of the roller or decentering of the roller.

In general, the main printing unit of the printing apparatus is formed from a printhead and a plurality of conveyance rollers provided on the upstream or downstream side of the printhead. In the printing apparatus having this arrangement, the conveyance amount upon switching the roller involved in conveyance is particularly problematic concerning the printing medium conveyance accuracy. For example, when switching from a state in which the printing medium is conveyed by two conveyance rollers on the upstream and downstream sides to a state in which the printing medium is conveyed only by the conveyance roller on the downstream side, the conveyance accuracy may lower due to the influence of the conveyance amount difference between the conveyance rollers. More specifically, bending that has occurred in the conveyance roller on the downstream side due to the conveyance amount difference between the conveyance rollers is released. This fluctuates the conveyance amount and lowers the image quality. To cope with this problem, Japanese Patent Laid-Open No. 2010-46994 proposes a method of correcting the conveyance amount in consideration of the influence of bending upon switching the conveyance state.

In the method of Japanese Patent Laid-Open No. 2010-46994, the influence of bending of the conveyance roller on the downstream side is corrected based on the conveyance amounts of the conveyance rollers at the time of switching the conveyance state. However, there exists a response delay of bending occurrence in the conveyance roller with respect to the conveyance amounts of the respective conveyance rollers. The image quality can further be improved by considering the response delay as well.

SUMMARY OF THE INVENTION

The present invention provides a technique capable of coping with a fluctuation in the conveyance amount upon switching the conveyance state.

According to the present invention, there is provided, for example, a printing apparatus comprising: a printing unit configured to print an image on a printing medium; a first conveying unit configured to convey the printing medium; a second conveying unit provided on a downstream side of the first conveying unit along a conveyance direction of the printing medium and configured to convey the printing medium; a driving unit configured to drive the first conveying unit and the second conveying unit; and a control unit configured to control the driving unit, a conveyance state of the printing medium making transition from a first conveyance state in which the printing medium is conveyed only by the first conveying unit out of the first conveying unit and the second conveying unit to a second conveyance state in which the printing medium is conveyed by both the first conveying unit and the second conveying unit and further making transition from the second conveyance state to a third conveyance state in which the printing medium is conveyed only by the third conveying unit, wherein the control unit recursively calculates a load mutually acting on the first conveying unit and the second conveying unit through the printing medium in the second conveyance state for each predetermined conveyance unit while setting an initial value to 0, and controls the driving unit based on a calculation result of the load at the time of the transition to suppress a fluctuation in a conveyance amount at the time of the transition of the conveyance state from the second conveyance state to the third conveyance state.

Further features of the present invention will become apparent from the following description of exemplary embodiments (with reference to the attached drawings).

BRIEF DESCRIPTION OF THE DRAWINGS

FIG. 5 is a view showing an example of a table that stores conveyance amounts for the respective rotational phase sections;

FIG. 9 is a view for explaining repetitive calculation performed for the respective rotational phase intervals to calculate a correction value at the time of transition from the second conveyance state to the third conveyance state;

FIG. 12 is a view for explaining repetitive calculation performed for the respective rotational phase intervals to calculate a correction value according to the second embodiment;

FIG. 14 is a view showing an example of a table that stores the conveyance amounts for the respective rotational phase sections in the printing apparatus shown in FIG. 13;

FIG. 16 is a view showing arithmetic expressions.

DESCRIPTION OF THE EMBODIMENTS

First Embodiment

Figure 1:
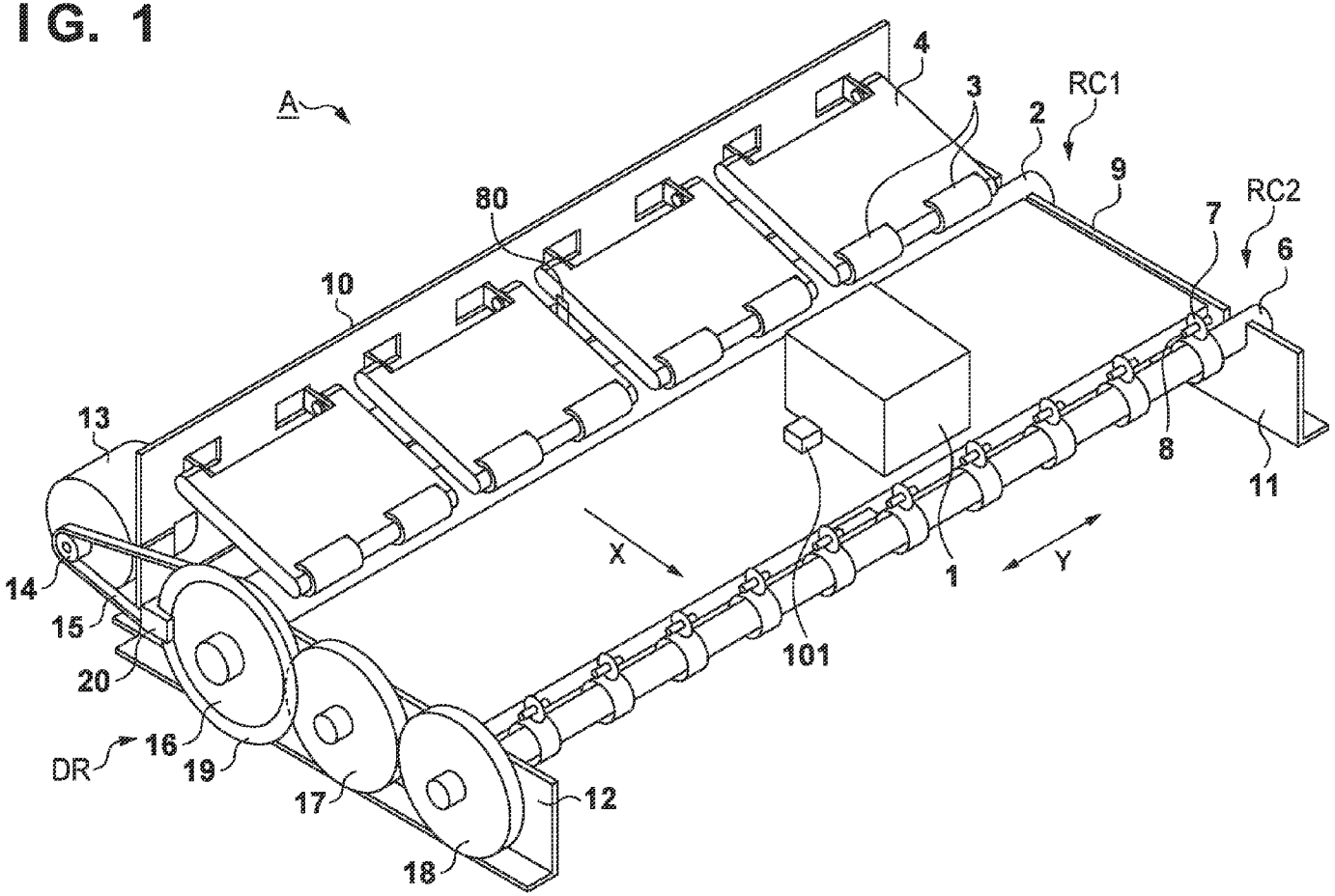
FIG. 1 is perspective view of the mechanism unit of a printing apparatus according to one embodiment of the present invention.

FIG. 1 is perspective view of the mechanism unit of a printing apparatus A according to this embodiment. In this embodiment, a case in which the present invention is applied to an serial inkjet printing apparatus will be described. However, the present invention is applicable to a printing apparatus of another type as well.

Note that "print" not only includes the formation of significant information such as characters and graphics, but also broadly includes the formation of images, figures, patterns, and the like on a print medium, or the processing of the medium, regardless of whether they are so visualized as to be visually perceivable by humans. Additionally, in this embodiment, a "print medium" is assumed to be a paper sheet, but may be cloth, a plastic film, or the like.

<Arrangement of Apparatus>

The printing apparatus A mainly includes a printing unit that prints on a printing medium, a sheet feeding unit (not shown) that feeds the printing medium, a sheet conveying unit that conveys the printing medium, and a control unit that controls the operation of each mechanism. The respective units will be described below.

The printing unit prints an image on a printing medium by a printhead (not shown) mounted on a carriage 1. The printing medium conveyed by the sheet conveying unit to be described later is supported by a platen 9 from below. The printhead located above discharges ink to print an image based on print image information on the printing medium. The carriage 1 can be moved by a driving mechanism (not shown) in a scanning direction Y perpendicular to a conveyance direction X shown in FIG. 1. The carriage 1 prints the image in the direction of the printing medium width while moving in the scanning direction. The carriage 1 is provided with a scanner (optical sensor) 101.

The sheet feeding unit (not shown) is provided on the upstream side of the printing unit along the conveyance direction. The sheet feeding unit separates each printing medium from a bundle thereof and supplies it to the sheet conveying unit.

The sheet conveying unit is provided on the downstream side of the sheet feeding unit along the conveyance direction and conveys the printing medium fed from the sheet feeding unit. The sheet conveying unit includes a conveying unit RC1, a conveying unit RC2, and a driving unit DR. The main mechanisms of the sheet conveying unit are supported by a main side plate 10, a right side plate 11, and a left side plate 12.

The conveying unit RC1 is provided on the upstream side of the printing unit along the printing medium conveyance direction. The conveying unit RC1 includes a main conveyance roller 2 and pinch rollers 3, and conveys the printing medium sandwiched between them. The main conveyance roller 2 is formed from a metal shaft with a surface coating of fine ceramic particles. The metal portions of the two ends are supported by the right side plate 11 and the left side plate 12, respectively, through bearings. Each pinch roller holder 4 holds a plurality of pinch rollers 3. The pinch rollers 3 are rotation members that rotate in accordance with the main conveyance roller 2. The pinch roller holders 4 press the pinch rollers 3 against the main conveyance roller 2 by pinch roller springs (not shown).

The conveying unit RC2 is provided on the downstream side of the conveying unit RC1 and the printing unit along the printing medium conveyance direction. The conveying unit RC2 includes a discharge roller 6 and spurs 7, and conveys the printing medium sandwiched between them. The discharge roller 6 is formed from a metal shaft and rubber portions. The plurality of spurs 7 are attached to a spur holder (not shown) provided at a position facing the discharge roller 6. The spurs 7 are rotation members that rotate in accordance with the discharge roller 6. Springs 8 each formed from a rod-like coil spring press the spurs 7 against the discharge roller 6.

The driving unit DR drives the conveying unit RC1 and the conveying unit RC2. The driving unit DR includes a conveyance motor 13 formed from a DC motor as a driving source. The driving force of the conveyance motor 13 is transmitted to a pulley gear 16 provided on the axis of the main conveyance roller 2 through a conveyance motor pulley 14 and a timing belt 15. The main conveyance roller 2 is thus rotated. The pulley gear 16 includes a pulley portion and a gear portion. Driving of the gear portion is transmitted to a discharge roller gear 18 through an idler gear 17. The discharge roller 6 is thus driven as well.

The printing apparatus A includes a sensor for detecting the rotation amount of the main conveyance roller 2. This sensor includes a code wheel 19 and an encoder sensor 20. The code wheel 19 is directly coaxially coupled to the main conveyance roller 2. Slits are formed at a pitch of 150 to 360 lpi. The encoder sensor 20 is fixed to the left side plate 12, and reads the count and timing of passage of the slits on the code wheel 19.

An origin phase slit used to detect the origin phase of the main conveyance roller 2 is formed on the code wheel 19. The encoder sensor 20 detects the origin phase slit, thereby detecting the origin phase position of the main conveyance roller 2.

In this embodiment, the speed ratio between the main conveyance roller 2 and the discharge roller 6 is 1:1. The speed ratio between the conveyance roller gear 16, the idler gear 17, and the discharge roller gear 18, which form the driving transmission mechanism to the main conveyance roller 2 and the discharge roller 6, is also 1:1. With this arrangement, the rotation period of the main conveyance roller 2 equals those of the discharge roller 6 and the gears. When the main conveyance roller 2 rotates by one period, the discharge roller 6 and the gears also rotate by one period.

Hence, in this embodiment, the rotation amount of the discharge roller 6 can also be managed by the code wheel 19 and the encoder sensor 20 provided on the main conveyance roller 2. A rotation amount sensor for the discharge roller 6 may be provided, as a matter of course.

Furthermore, all the conveyance amount errors that occur due to geometrical shifts such as decentering of the rollers or the transmission errors of the gears and fluctuate in accordance with the rotational phases of the rollers and gears are integrated in correspondence with one rotation of the main conveyance roller 2.

Note that in this embodiment, a state in which the printing medium is conveyed only by the main conveyance roller 2 will be referred to as a first conveyance state. A state in which the printing medium is conveyed by cooperation of the main conveyance roller 2 and the discharge roller 6 will be referred to as a second conveyance state. A state in which the printing medium is conveyed only by the discharge roller 6 will be referred to as a third conveyance state. That is, when the printing medium is conveyed from the sheet feeding unit, the first conveyance state is obtained first. When the printing medium conveyance by the main conveyance roller 2 progresses, and the printing medium reaches the discharge roller 6, the second conveyance state is obtained. When the printing medium conveyance by the main conveyance roller 2 and the discharge roller 6 progresses, and the printing medium leaves the main conveyance roller 2, the third conveyance state is obtained.

Figure 2:
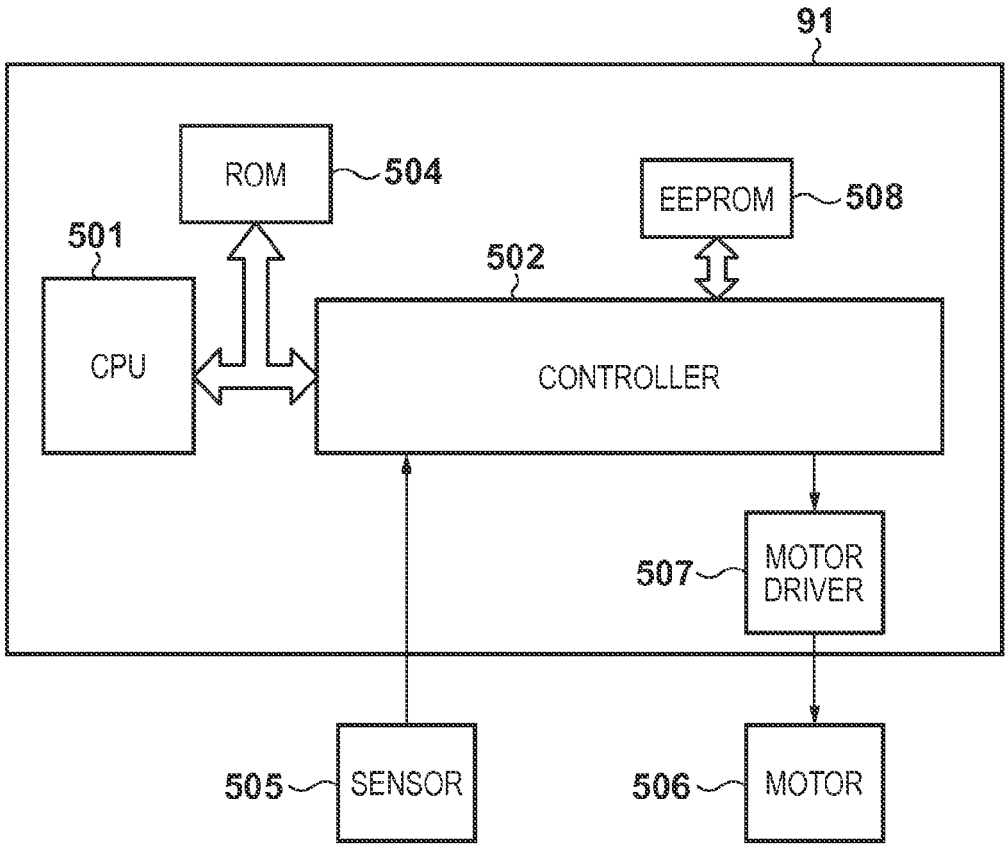
FIG. 2 is a control block diagram of the printing apparatus shown in FIG. 1.

FIG. 2 is a block diagram for explaining the arrangement of the control unit of the printing apparatus A. A control unit 91 controls the operation of each mechanism unit of the printing apparatus A. Only parts associated with the explanation of the present invention will be described here. A CPU 501 controls the entire printing apparatus A. A controller 502 assists the CPU 501 and controls the driving of a motor 506 and the printhead.

A ROM 504 stores formulas to be described later, the control programs of the CPU 501, and the like. An EEPROM 508 stores conveyance amount information and the like to be described later. Note that other storage devices may be employed in place of the ROM 504 and the EEPROM 508.

A motor driver 507 drives the motor 506. The motor 506 includes the above-described conveyance motor 13. A sensor 505 includes the encoder sensor 20 and an edge sensor. The edge sensor detects the conveyance position of the printing medium. Passage of the leading edge or trailing edge of the printing medium can be detected based on the detection result of the sensor. In this embodiment, the edge sensor includes a detecting lever 80 shown in FIG. 1. The edge sensor detects the pivotal movement of the detecting lever 80, thereby detecting passage of the leading edge or trailing edge of the printing medium. The detecting lever 80 is arranged on the upstream side of the main conveyance roller 2.

For example, in accordance with the formulas stored in the ROM 504, the CPU 501 calculates the load between the rollers and the like in the second conveyance state from the conveyance amount information stored in the EEPROM 508. Additionally, for example, at the time of conveyance of the printing medium, the CPU 501 drives the motor 506 through the motor driver 507 and rotates the main conveyance roller 2 and the discharge roller 6. At this time, the CPU 501 acquires origin phase information and rotation amount information of the main conveyance roller 2 from the encoder sensor 20, thereby precisely rotating it. The CPU 501 also detects the conveyance position of the printing medium based on printing medium edge detection by the edge sensor, and grasps the timing of switching from the first conveyance state to the second conveyance state or the timing of switching from the second conveyance state to the third conveyance state. The CPU 501 sets the rotation amount (the control amount of the driving unit DR to the conveyance motor 13) of each of the main conveyance roller 2 and the discharge roller 6 based on the timings and the like. In particular, the correction value of the control amount at the time of transition of the conveyance state from the second conveyance state to the third conveyance state is calculated from the conveyance amount information and the formulas, and the control amount is corrected.

<Example of Control>

An example of control of the printing apparatus A will be described next mainly concerning conveyance control of the printing medium. Note that this embodiment assumes that the conveyance amount corresponding to a predetermined number of rotations of only the main conveyance roller 2 on the upstream side and the conveyance amount corresponding to a predetermined number of rotations of only the discharge roller 6 on the downstream side are different. This difference is intentionally given to the conveyance amounts of the rollers (for example, the roller diameter is changed). However, even if there is no intention of giving the difference, the finishing variation in the outer diameter between the rollers or decentering of the rollers eventually generates the difference.

In the second conveyance state, such a conveyance amount difference between the main conveyance roller 2 and the discharge roller 6 generates a load (inter-shaft force) between the main conveyance roller 2 and the discharge roller 6 through the printing medium, and the rollers bend. When transition from the second conveyance state to the third conveyance state occurs, the load is released, and the discharge roller 6 returns to the unbent state. In this embodiment, control is performed to suppress a fluctuation in the conveyance amount caused by the bend.

Let $\beta_{LF}$ be the conveyance amount in the first conveyance state, and $\beta_{EJ}$ be the conveyance amount in the third conveyance state. As described above, the conveyance amounts $\beta_{LF}$ and $\beta_{EJ}$ are different. Also let $\beta_{LFEJ}$ be the conveyance amount in the second conveyance state. The second conveyance state is a conveyance state in which the main conveyance roller 2 and the discharge roller 6 cooperatively convey the printing medium. Hence, in the second conveyance state, $\beta_{LFEJ}$ is decided by adjusting the conveyance amount between the main conveyance roller 2 and the discharge roller 6.

The conveyance amount of the printing medium is known to become small when a load is generated between the rollers through the printing medium, and the rollers slip. This can easily be confirmed by actually measuring the conveyance amount of the printing medium while applying a load to the printing medium using a suspended weight weighing a known value, and calculating the degree of slip with respect to the load of the weight.

A value concerning the conveyance change amount with respect to the load will be referred to as a conveyance characteristic coefficient $\alpha$. In this embodiment, the conveyance characteristic coefficient $\alpha$ is a value representing the slip amount with respect to the load. The value $\alpha$ will be described in more detail. The value $\alpha$ is calculated by {(conveyance amount when applying load)−(conveyance amount without applying load)}/(magnitude of load). Hence, the unit is (mm/N), and the value is negative. The value $\alpha$ can be obtained in advance by experiments for each of the main conveyance roller 2 and the discharge roller 6. The values are defined as $\alpha_{LF}$ and $\alpha_{EJ}$.

Since the conveyance amount $\beta_{LFEJ}$ is decided by causing the load to mutually act between the two shafts of the main conveyance roller 2 and the discharge roller 6, the conveyance amounts of the printing medium on the respective rollers are given by equations (1) shown in FIG. 16. Let $F_{LF}$ be the load applied to the main conveyance roller 2, and $F_{EJ}$ be the load applied to the discharge roller 6. Note that the positive direction of the two forces $F_{LF}$ and $F_{EJ}$ is opposite to the conveyance direction.

In equations (1) of FIG. 16, $F_{LF}$ and $F_{EJ}$ hold a relation $F_{LF}=-F_{EJ}$ based on the law of action and reaction. When this relation is applied to the equations (1) of FIG. 16, $F_{EJ}$ is given by equation (2) of FIG. 16.

Hence, the force applied to the two rollers 2 and 6 in the second conveyance state can be obtained using equation (2) of FIG. 16. When the thus obtained force $F_{EJ}$ is substituted into one of equations (1) of FIG. 16, the conveyance amount $\beta_{LFEJ}$ in the second conveyance state can be calculated. The bending amounts of the rollers can also be calculated based on this force and the rigidity coefficients of the rollers 2 and 6. Note that the rigidity coefficient is a value associated with the displacement amount of each roller with respect to the load, and can be calculated from the mechanical material physical properties and geometrical structures of each roller.

Conveyance amount changes caused by the bending of the conveyance rollers can be expressed as equations (3) of FIG.

16. Let $X_{LF}$ and $X_{EJ}$ be the conveyance amount changes caused by bending of the main conveyance roller 2 and the discharge roller 6. Let $K_{LF}$ and $K_{EJ}$ be the rigidity coefficients of the main conveyance roller 2 and the discharge roller 6. Let $\delta F_{LF}$ and $\delta F_{EJ}$ be the change amounts of the load applied to the main conveyance roller 2 and the discharge roller 6. Note that the rigidity coefficients $K_{LF}$ and $K_{EJ}$ are calculated from the mechanical material physical properties and geometrical structures of the main conveyance roller 2 and the discharge roller 6.

As is apparent from equations (3) of FIG. 16, the displacement amounts generated by the changes in the load are calculated using the Hooke's law. When $X_{LF}$ and $X_{EJ}$ are added to equations (1) of FIG. 16, respectively, as new terms, conveyance amount changes considering the bending of the rollers can be expressed. Let $F_n$ be the load amount applied to the discharge roller 6 after predetermined conveyance, and $F_{n-1}$ be the load amount before slight conveyance from $F_n$ to consider the load fluctuation. In this case, the conveyance amounts are given by equations (4) of FIG. 16. When equations (4) are solved for $F_n$, $F_n$ can be expressed as equation (5) of FIG. 16.

As can be seen from above explanation, the load amount $F_n$ at an arbitrary position is calculated recursively using the load amount $F_{n-1}$ in the immediately preceding conveyance state (the position one conveyance unit before). That is, when the initial condition (initial value) is given, the load amounts at the respective conveyance positions are continuously calculated using equation (5), thereby calculating the load amount at an arbitrary conveyance position. Note that the initial condition is the load applied to the main conveyance roller 2 and the discharge roller 6 upon switching from the first conveyance state to the second conveyance state, which is 0 as a matter of course.

Once the load amount applied to the discharge roller 6 can be calculated, the bending amount of the discharge roller 6 can be calculated from the load amount and the rigidity coefficient of the discharge roller 6.

Note that decentering of the main conveyance roller 2 and the discharge roller 6 and the like exist, the conveyance amount fluctuates at each rotation angle of a predetermined unit. The conveyance amounts of the main conveyance roller 2 and the discharge roller 6 are distinguished in accordance with a rotational phase position m. Let $D_{LFm}$ be the conveyance amount of the main conveyance roller 2 at the rotational phase position m. Let $D_{EJm}$ be the conveyance amount of the discharge roller 6 at the rotational phase position m. Then, the load amount can be expressed as equation (6) of FIG. 16. In equation (6), $\alpha_{LF}$, $\alpha_{EJ}$, $K_{LF}$, $K_{EJ}$, and $F_0$ are known. Hence, when the conveyance amounts $D_{LFm}$ and $D_{EJm}$ of the rollers at each rotational phase position are known, the load amount after arbitrary conveyance can be calculated.

As one characteristic feature of this embodiment, the load at an arbitrary conveyance position is recursively calculated by reflecting not only the conveyance amount of each roller at that conveyance position but also the conveyance amount of each roller at the immediately preceding conveyance position. This makes it possible to calculate the dynamic bending fluctuations of the main conveyance roller 2 and the discharge roller 6 so that the response delay of bending occurrence with respect to the conveyance amounts is also reflected on the calculation result.

Figure 3A:
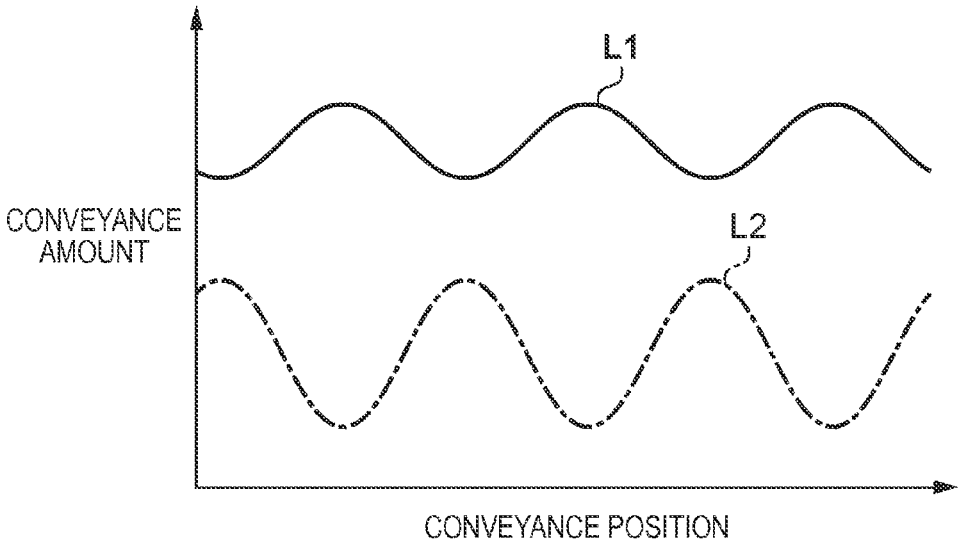
FIGS. 3A and 3B are explanatory views of the difference between load calculation methods.
Figure 3B:
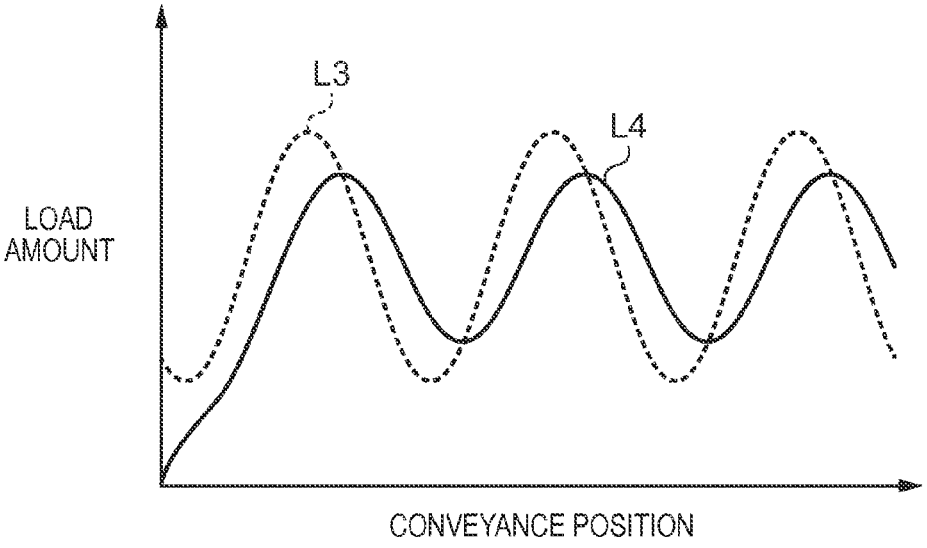

FIGS. 3A and 3B are explanatory views of the difference between load calculation methods. FIG. 3A shows examples of the conveyance amount changes of the main conveyance roller 2 and the discharge roller 6. FIG. 3B shows examples of calculation of the load amounts with respect to the conveyance amount changes in FIG. 3A, indicating load changes from the start of the second conveyance state.

Referring to FIG. 3A, a line L1 indicates an example of a fluctuation in the conveyance amount of the discharge roller 6, and a line L2 indicates an example of a fluctuation in the conveyance amount of the main conveyance roller 2. Referring to FIG. 3B, a line L4 indicates a case in which the load amount is calculated by the calculation method of this embodiment. A line L3 indicates a case in which the load amount is calculated from the conveyance amount difference between the rollers at the conveyance positions, that is, an example in which the response delay of bending occurrence is neglected. In the calculation method indicated by the line L3, the conveyance amount difference between the rollers directly appears as the magnitude of the load amount. On the other hand, in the calculation method of this embodiment indicated by the line L4, a transient load fluctuation is exhibited immediately after the start of the second conveyance state, and after that, a stable periodical fluctuation occurs. Additionally, the fluctuation in the load amount occurs with a delay with respect to the conveyance amount difference between the rollers, as can be seen. The difference between the line L3 and the line L4 indicates the superiority of the load amount calculation of this embodiment and the effect of improving conveyance amount correction control.

A method of acquiring the conveyance amount (to be referred to as a phase interval conveyance amount hereinafter) for a predetermined conveyance unit (in this case, for each phase (rotation angle)) in the first and third conveyance states by actual measurement will be described next with reference to FIGS. 4, 5, and 6. Note that the phase interval conveyance amount acquisition method to be described below is merely an example, and another method can also be employed. This phase interval conveyance amount acquisition can be executed in the factory or by the user before actual printing.

Figure 4:
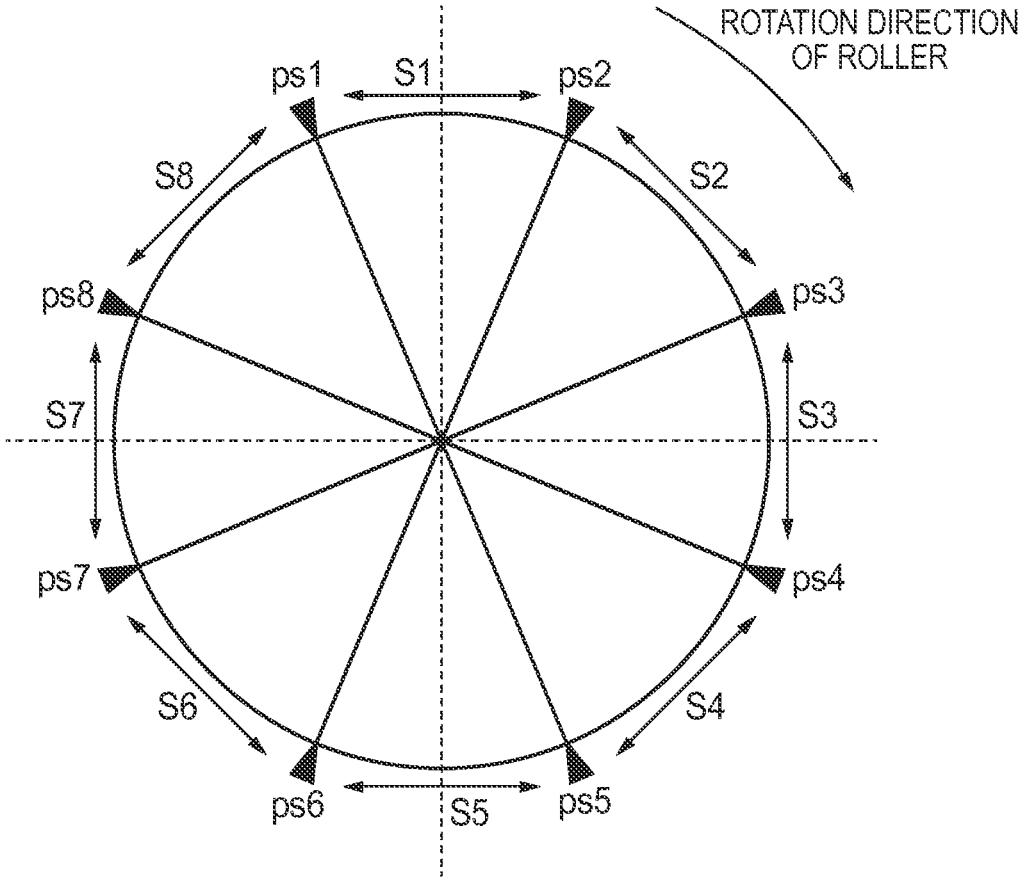
FIG. 4 is a conceptual view of the rotational phase sections of a conveyance roller.

FIG. 4 is a conceptual view of eight rotational phase intervals S1 to S8 formed by dividing the roller periphery into eight parts. Referring to FIG. 4, each of positions ps1 to ps8 indicates the position of the rotational phase of the roller at which sheet conveyance starts upon printing a test pattern to be described later. Note that in this embodiment, the periphery of each of the main conveyance roller 2 and the discharge roller 6 is divided into eight parts, and conveyance amount correction is controlled for each of the eight rotational phase intervals S1 to S8.

FIG. 5 shows a table (conveyance amount information) that stores phase interval conveyance amounts D for the predetermined rotational phase intervals in the first and third conveyance states.

The phase interval conveyance amounts D are set as $D_{LF1}$ to $D_{LF8}$ and $D_{EJ1}$ to $D_{EJ8}$ for the main conveyance roller 2 and the discharge roller 6, respectively. The conveyance amounts $\beta_{LF}$ and $\beta_{EJ}$ when switching the conveyance state in the actual printing operation are decided using the phase interval conveyance amounts D. Referring to FIG. 5, the phase interval conveyance amounts D are stored for each of the eight rotational phase intervals S1 to S8 in correspondence with the first and third conveyance states. FIG. 6 is a view showing examples of test patterns used to acquire the phase interval conveyance amounts D concerning the first and third conveyance states.

First, the above-described roller origin phase detection processing is performed to determine the origins of the rollers and set a state in which the rotational phase of each roller can be managed. In this state, test patterns P as shown in FIG. 6 are printed.

When printing the test patterns, first, a test pattern P1 is printed in the first conveyance state in which the printing medium is conveyed only by the main conveyance roller 2. After the leading edge of the printing medium has passed the main conveyance roller 2, the printing medium is conveyed until the rotational phase of the main conveyance roller 2 reaches the position ps1. At the position ps1, a first test pattern 2001 is printed. After the pattern printing has ended, the conveyance of the printing medium is started from the position ps1. The printing medium is conveyed until the rotational phase of the roller reaches the position ps2, and a second test pattern 2002 is printed. In this case, the pattern interval between the first test pattern 2001 and the second test pattern 2002 corresponds to the conveyance amount in the rotational phase section S1 from the position ps1 to the position ps2. Similarly, after the second pattern printing has ended, the conveyance of the printing medium is started from the position ps2. The printing medium is conveyed until the rotational phase of the roller reaches the position ps3, and a third test pattern 2003 is printed.

The above-described operation is repetitively performed until the rotational phase of the main conveyance roller 2 returns to the position ps1 again. In this embodiment, nine test patterns 2001 to 2009 are printed by repetitively performing the operation.

Subsequently, a test pattern P2 is printed in the third conveyance state in which the printing medium is conveyed only by the discharge roller 6. After the trailing edge of the printing medium has passed the nip portion of the main conveyance roller 2, and the rotational phase of the discharge roller 6 has reached the position ps1, a first test pattern 2011 is printed. Next, the conveyance of the printing medium is started from the position ps1. The printing medium is conveyed until the rotational phase reaches the position ps2, and a second test pattern 2012 is printed. The above-described operation is repetitively performed until the rotational phase of the discharge roller 6 returns to the position ps1 again. Nine test patterns 2011 to 2019 are thus printed.

After all test patterns are printed, the pattern intervals between the test patterns 2001 to 2009 and 2011 to 2019 are measured by the scanner (optical sensor) 101 provided on the carriage 1.

The pattern intervals between the test patterns 2001 to 2009 correspond to the conveyance amounts in the rotational phase sections S1 to S8 of the conveyance roller 2, respectively. The pattern intervals between the test patterns 2011 to 2019 correspond to the conveyance amounts in the rotational phase sections S1 to S8 of the discharge roller 6, respectively. Hence, the conveyance amounts in the rotational phase sections S1 to S8 in the first conveyance state can be acquired by measuring the pattern intervals between the test patterns 2001 to 2009. Similarly, the conveyance amounts in the rotational phase sections S1 to S8 in the third conveyance state can be acquired by measuring the pattern intervals between the test patterns 2011 to 2019.

The phase interval conveyance amounts obtained in the above-described way are stored in $D_{LF1}$ to $D_{LF8}$ and $D_{EJ1}$ to $D_{EJ8}$ of the table shown in FIG. 5. With the above-described series of operations, the phase interval conveyance amounts D in the first and third conveyance states can be acquired.

Note that in this embodiment, the predetermined phase interval is ⅛ the roller periphery. The number of predetermined phase intervals can be set arbitrarily. However, if the interval of the stored conveyance amounts is large, the accuracy of load calculation using equation (6) described above lowers relatively. As the number of predetermined phase intervals, an appropriate number of divisions is decided in advance based on, for example, the rigidities or diameters of the rollers.

In this embodiment, nine test patterns are printed at eight pattern intervals in each of the first and third conveyance states. The number of pattern intervals equals the number of rotational phase intervals of each roller managed in the printing apparatus A. However, for example, to improve the measurement accuracy, the number of pattern intervals may be larger than the number of rotational phase intervals of each roller. Alternatively, to shorten the measurement time, the number of pattern intervals may be smaller than the number of rotational phase intervals of each roller. However, if the number of pattern intervals and the number of rotational phase intervals of each roller are different, the conveyance amount for each rotational phase interval needs to be calculated by performing, for example, interpolation processing of measurement values.

Figure 7:
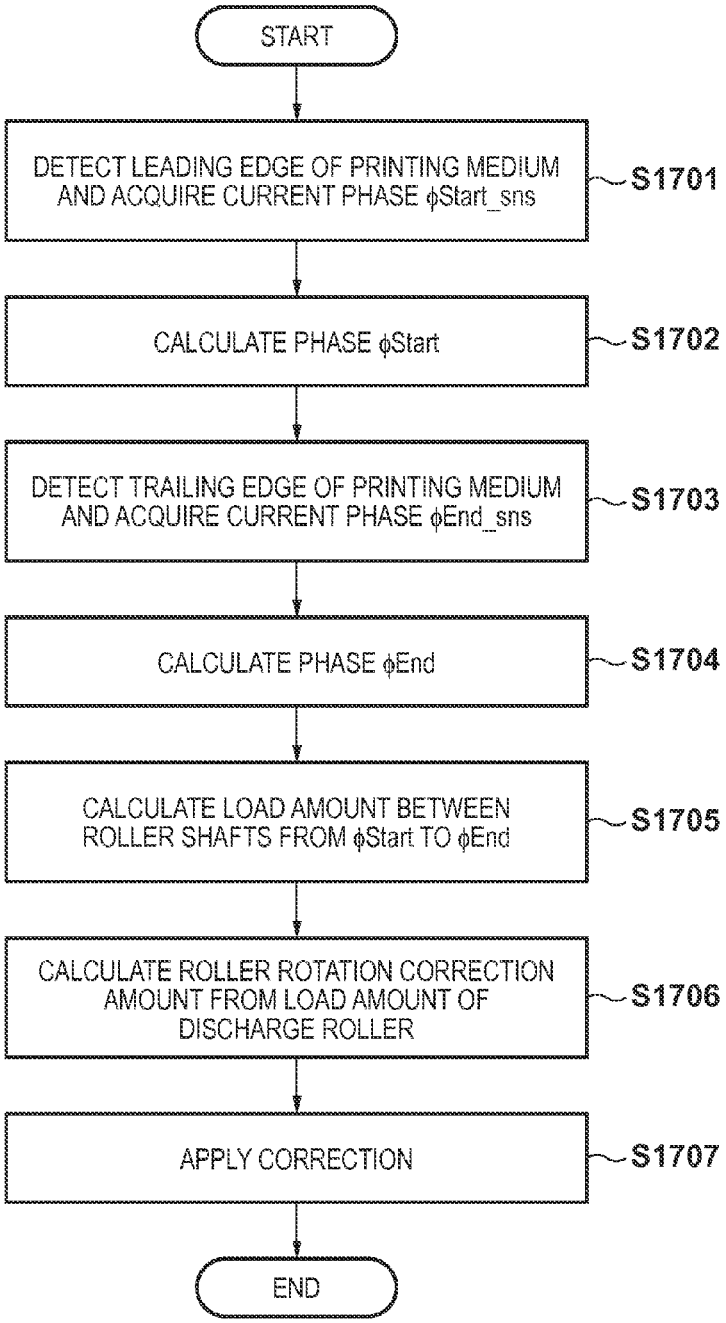
FIG. 7 is a flowchart of control at the time of printing.

A method of controlling conveyance of the printing medium in the actual printing operation to suppress the fluctuation in the conveyance amount at the time of transition from the second conveyance state to the third conveyance state will be described with reference to FIGS. 7, 8A to 8D, and 9. FIG. 7 illustrates the control procedure in the actual printing operation. FIGS. 8A to 8D are views for explaining a method of acquiring the rotational phase position of the roller at the time of transition from the second conveyance state to the third conveyance state. FIG. 9 is a view for explaining repetitive calculation performed for the respective rotational phase intervals to calculate a correction value at the time of transition from the second conveyance state to the third conveyance state. Acquisition of the rotational phase position will be described first with reference to FIGS. 8A to 8D.

Figures 8A, 8B, 8C, 8D:
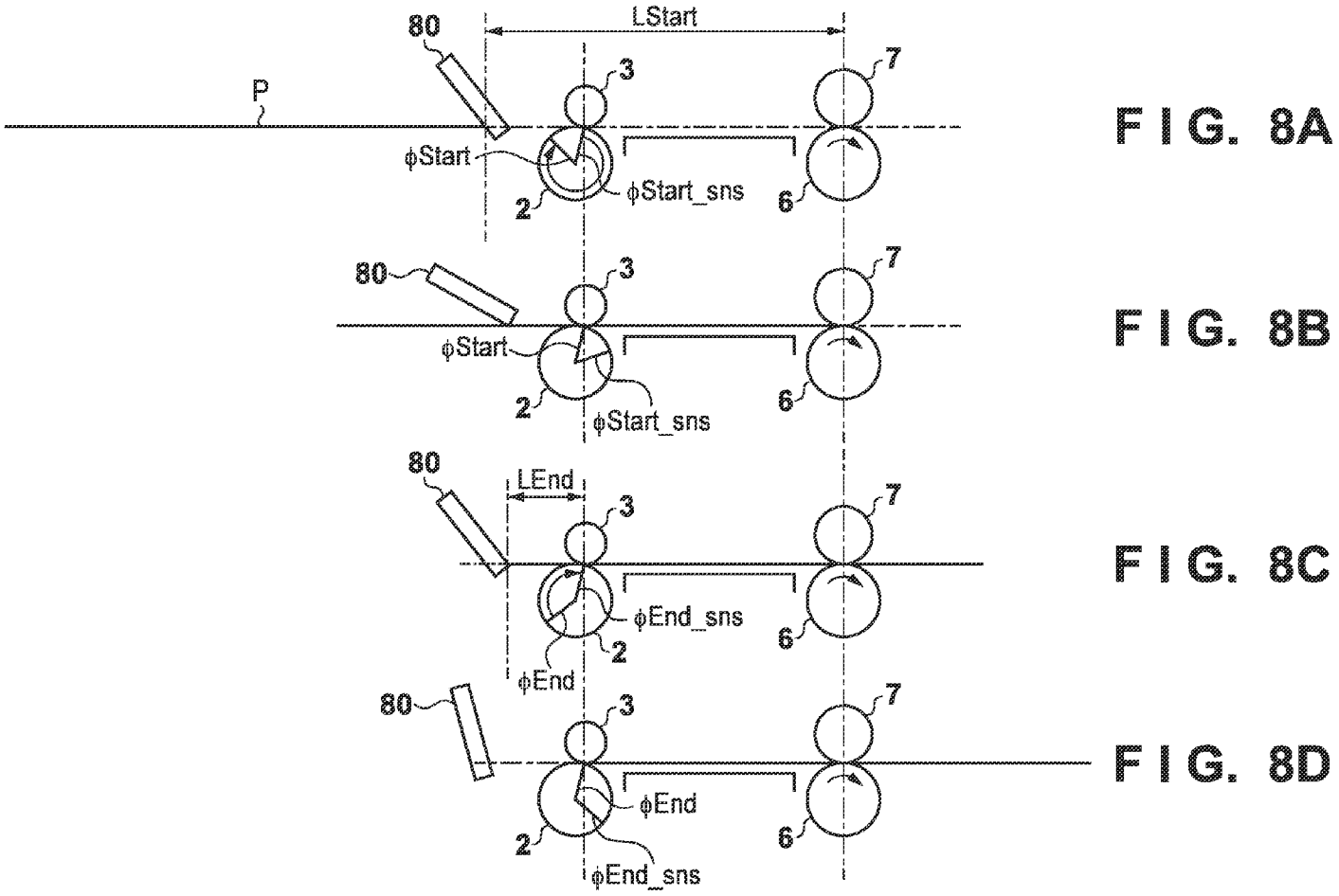
FIGS. 8A to 8D are views for explaining a method of acquiring the rotational phase position of the roller at the time of transition from a second conveyance state to a third conveyance state.

FIG. 8A shows a state in which the leading edge of the printing medium comes into contact with the detecting lever 80 provided on the upstream side of the main conveyance roller 2 to make the detecting lever 80 pivot, and the arrival of the leading edge of the printing medium is detected by the edge sensor. The rotational phase of the roller at that time is ϕStart_sns. FIG. 8B shows a state in which the leading edge of the printing medium enters the nip portion of the discharge roller 6. The rotational phase of the roller at that time is ϕStart.

FIG. 8C shows a state in which the trailing edge of the printing medium passes the detecting lever 80 to make the detecting lever 80 pivot, and the arrival of the trailing edge of the printing medium is detected by the edge sensor. The rotational phase of the roller at that time is ϕEnd_sns. FIG. 8D shows a state in which the trailing edge of the printing medium leaves the nip portion of the main conveyance roller 2. The rotational phase of the roller at that time is ϕEnd.

A description will be made based on the above-described assumption with reference to the control procedure shown in FIG. 7.

When the printing apparatus A receives the signal of the image printing operation, the sheet feeding unit feeds the printing medium, and the printing medium enters the detecting lever 80 on the upstream side of the main conveyance roller 2. Referring to FIG. 7, in step S1701, the edge sensor detects the leading edge of the printing medium, and the encoder sensor 20 acquires the current phase ϕStart_sns (FIG. 8A).

When image printing on the printing medium progresses, the leading edge of the printing medium reaches the nip portion of the discharge roller 6, as shown in FIG. 8B. At this time, in step S1702, the rotational phase ϕStart at which the second conveyance state starts is obtained by calculation. As shown in FIG. 8A, let LStart be the distance from the printing medium leading edge detection position to the start of conveyance in the second conveyance state. The rotational phase ϕStart at which the conveyance in the second conveyance state starts can be calculated from LStart and ϕStart_sns acquired in step S1701.

When image printing on the printing medium progresses, the trailing edge of the printing medium reaches the detecting lever 80, as shown in FIG. 8C. At this time, in step S1703, the trailing edge of the printing medium is detected, and the encoder sensor 20 acquires the current phase ϕEnd_sns.

In step S1704, the rotational phase ϕEnd at which the transition from the second conveyance state to the third conveyance state occurs is obtained by calculation. As shown in FIG. 8C, let LEnd be the distance from the trailing edge detection position to the transition position. The rotational phase ϕEnd at which the printing medium is transferred can be calculated from LEnd and ϕEnd_sns acquired by the sensor.

In step S1705, a load amount (to be referred to as Fa) applied to the discharge roller 6 at the time of transition from the second conveyance state to the third conveyance state is calculated.

The load amount Fa is calculated using the phase interval conveyance amounts D for the respective rotational phases from the rotational phase ϕStart at which the leading edge of the printing medium reaches the nip portion of the discharge roller 6 up to the rotational phase ϕEnd at which the trailing edge of the printing medium passes the nip portion of the main conveyance roller 2.

More specifically, the load amount is calculated by sequentially expanding the phase interval conveyance amounts stored in correspondence with the rotational phase ϕStart, as shown in FIG. 9, using equation (6) described above. In the example shown in FIG. 9, the rotational phase section S6 corresponds to the rotational phase ϕStart.

In FIG. 9, the conveyance amounts of the rollers at conveyance position 1 of the start point ϕStart of the second conveyance state are $D_{LF6}$ and $D_{EJ6}$, respectively. Since the load applied to the discharge roller is 0 at the start point ϕStart, a load amount $F_1$ at conveyance position 1=0.

At conveyance position 2, since the roller phase advances by one step, the conveyance amounts of the rollers are $D_{LF7}$ and $D_{EJ7}$, respectively. A load amount $F_2$ applied to the discharge roller at conveyance position 2 is calculated as follows in accordance with equation (6). That is, the load amount is calculated by substituting $F_1$ and the conveyance amounts ($D_{LF6}$ and $D_{EJ6}$) of the rollers at the immediately preceding conveyance position into equation (6).

In the above-described way, substitution of phase interval conveyance amounts corresponding to each conveyance position and calculation of the load amount applied to the discharge roller 6 are sequentially executed up to the conveyance position corresponding to ϕEnd, thereby calculating the load amount Fa.

In step S1706, the correction amount at the time of transition from the second conveyance state to the third conveyance state is calculated using the load amount Fa applied to the discharge roller 6 which is calculated in the preceding step.

The conveyance amount fluctuation elements include a conveyance amount fluctuation caused by decentering or diameter shift of a roller and a conveyance amount fluctuation caused by release of bending of the discharge roller 6 caused by the load between the rollers, as already described. The conveyance amount fluctuation caused by release of bending of the discharge roller 6 is calculated by equation (7) shown in FIG. 16, where $Z_{KICK}$ is the correction value that suppresses the conveyance amount fluctuation caused by release of bending. In addition, J is a value decided from the mechanical material physical properties and geometrical structure of the discharge roller 6. The value J is theoretically calculated or acquired by experiments in advance.

Correction of the conveyance amount fluctuation caused by decentering or diameter shift of a roller is known, and a detailed description thereof will be omitted. Letting $Z_{FEED}$ be the conveyance correction value, a correction value Z at the time of transition of the conveyance state can eventually be expressed as equation (8) of FIG. 16.

When the printing medium passes the detecting lever 80, and image printing on the printing medium progresses, the trailing edge of the printing medium passes the nip portion of the main conveyance roller 2, as shown in FIG. 8D. That is, transition from the second conveyance state to the third conveyance state occurs. At this time, the rotation amounts (control amounts) of the main conveyance roller 2 and the discharge roller 6 are corrected based on the correction value Z, and the printing medium conveyance is executed (step S1707). Let δθ be the rotation amount of the roller to be corrected here. The rotation amount δθ is calculated by equation (9) of FIG. 16. In equation (9), L is the ideal conveyance amount of the printing medium conveyed by one rotation of the roller. Note that the unit of δθ is radian.

Note that when performing correction using $Z_{KICK}$ using the above-described conveyance amount information as a reference, $Z_{FEED}$ to be used for the conveyance amount fluctuation caused by decentering or diameter shift of a roller can be omitted because the fluctuation is already included. That is, the correction value Z changes depending on whether the theoretical conveyance amount is used as a reference, or part of the conveyance amount fluctuation is already included as in the case in which the conveyance amount information is used, as a matter of course.

Even after the transition of the conveyance state, image printing continues, and the image is printed on the entire surface of the printing medium. When image printing on the entire surface of the printing medium has ended, the printing medium is discharged by the discharge roller 6 onto a discharge tray, and the image printing operation is completed.

As described above, in this embodiment, the driving unit DR is controlled by setting the control amount based on the load Fa to suppress the conveyance amount fluctuation at the time of transition from the second conveyance state to the third conveyance state. At this time, the load Fa is decided based on not only the conveyance amounts (phase fluctuation conveyance amounts) of the main conveyance roller 2 and the discharge roller 6 at the time of transition but also the conveyance amounts (phase fluctuation conveyance amounts) of the main conveyance roller 2 and the discharge roller 6 before transition. In other words, the load Fa is recursively calculated to reflect the dynamic change of bending of the discharge roller 6 on the calculation result so that the bending amount of the discharge roller 6 can be predicted more accurately. This makes it possible to cancel the conveyance amount fluctuation upon switching the conveyance state and avoid degradation in image quality.

In this embodiment, calculation is executed by predicting the calculation start point (ϕStart) and the end point (ϕEnd) using the detection information of the leading edge position and the trailing edge position of the printing medium. However, calculation may be done by predicting the start point and the end point from the length information of the printing medium using one of the pieces of information. Without performing detection, the conveyance correction amount may be calculated in advance by predicting the calculation start point and the calculation end point before the sheet feeding operation.

Figure 6:
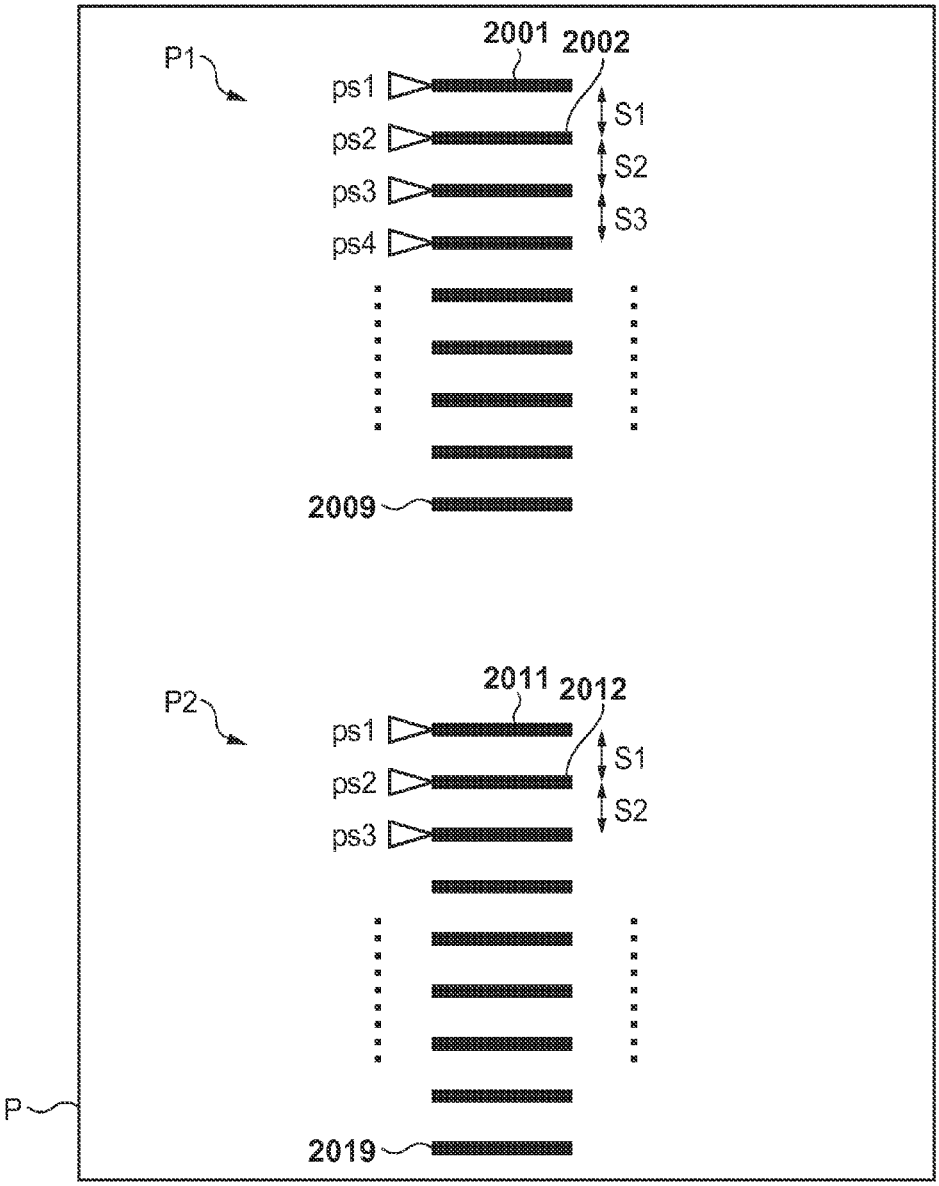
FIG. 6 is a view showing examples of test patterns used to acquire actual conveyance amounts.

In this embodiment, when setting the phase interval conveyance amounts D in FIG. 6, $D_{LF}$ and $D_{EJ}$ are actually measured in the first and third conveyance states. However, the conveyance states of the actual measurement target are not limited to those. That is, the phase interval conveyance amounts may be set based on the actual measurement values in the first conveyance state and the second conveyance state (in this case, measurement values of actual conveyance amounts concerning $D_{LF}$ and $D_{LFEJ}$ corresponding to $L_{LFEJ}$ are obtained). The phase interval conveyance amounts may be set based on the actual measurement values in the third conveyance state and the second conveyance state (in this case, measurement values of actual conveyance amounts concerning $D_{EJ}$ and $D_{LFEJ}$ are obtained). If the second conveyance state is included in the actual measurement target, the conveyance amounts in the first and third conveyance states are calculated from the conveyance amounts in a known conveyance state using the two equations (1) in FIG. 16 and performing the same step as described above, thereby calculating the conveyance amount changes. However, the conveyance amounts in the second conveyance state of equations (1) in FIG. 16 need to be conveyance amounts in a state in which the load fluctuation is stable.

In this embodiment, load calculation is performed at the time of trailing edge detection of the printing medium. However, the calculation can be executed at any timing after all the pieces of necessary information are obtained.

In this embodiment, the speed ratio between the main conveyance roller 2 and the discharge roller 6 is 1:1. However, the present invention is not limited to this and is also applicable to a case in which an arbitrary speed ratio m:n is set. If the speed ratio between the two rollers changes, the ideal conveyance amount per predetermined rotation amount changes depending on the roller. In this case, calculation is performed after the conveyance amounts stored for the respective rollers are added such that the rotational phase interval conveyance amounts $D_{LFm}$ and $D_{EJm}$ to be substituted into equation (6) become the same ideal conveyance amount.

The present invention is applicable not only to a printing apparatus such as a printer but also to various kinds of conveyance apparatuses for conveying various kinds of conveyance target objects. An example is a sheet feed scanner.

Second Embodiment

In the first embodiment, when calculating the load on the discharge roller 6, the calculation is executed throughout the second conveyance state. However, the load amount calculation need not always be executed throughout the second conveyance state. Instead, the load may be calculated from a midstream of the second conveyance state up to the time of transition to the third conveyance state. This can shorten the calculation time.

In this embodiment, a form will be explained in which a condition under which the calculation time can be saved is judged, and load calculation is executed while appropriately saving the calculation time.

Figure 10A:
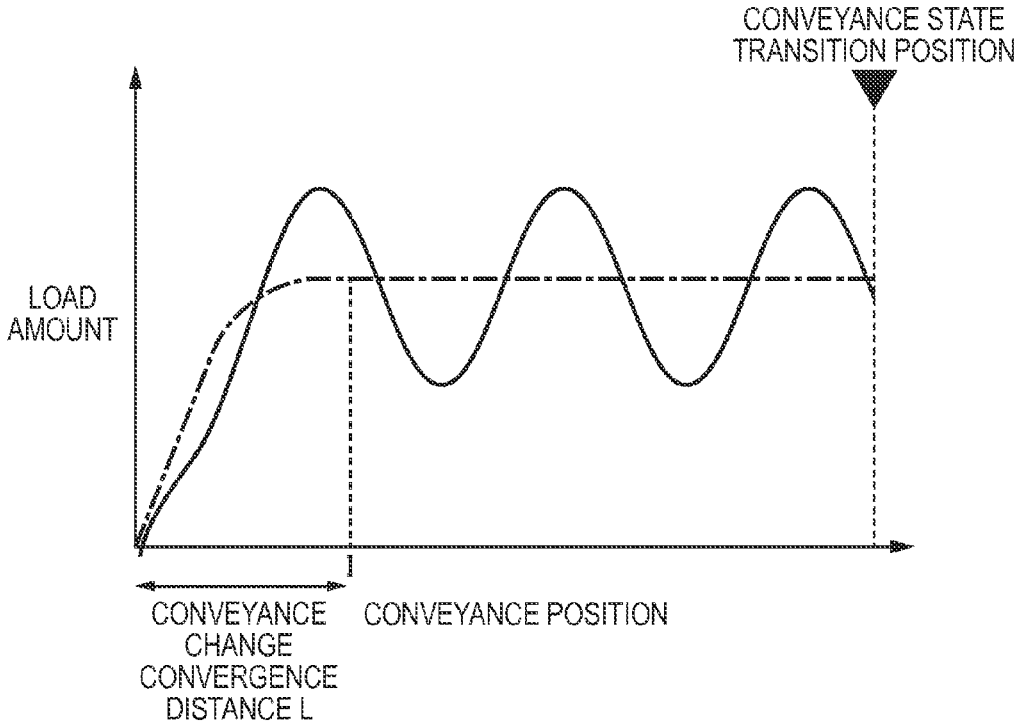
FIGS. 10A and 10B are explanatory views of another example of a load calculation section.

FIG. 10A is a graph showing an example in which the load amount applied to a discharge roller 6 is calculated using equation (6). The graph of FIG. 10A represents the load amount after the leading edge of a printing medium has reached the nip portion of the discharge roller 6 until the trailing edge of the printing medium leaves the nip portion of a main conveyance roller 2. The broken line in FIG. 10A indicates the approximate value of the load amount.

As can be seen from this graph, the load amount exhibits two changes, that is, a large load amount change up to a conveyance position I and a periodical load amount change observed throughout the conveyance positions. The former large load amount change occurs due to the conveyance amount difference that is generated between the main conveyance roller 2 and the discharge roller 6 in a steady state. As the properties, when the two rollers start cooperatively conveying the printing medium, and the conveyance progresses a predetermined distance, the difference converges to a predetermined value. On the other hand, the latter periodical load amount change occurs due to the conveyance amount difference caused by decentering that exists in each of the two rollers. As the properties, the difference continuously exists even when the two rollers continue cooperatively conveying the printing medium.

Figure 10B:
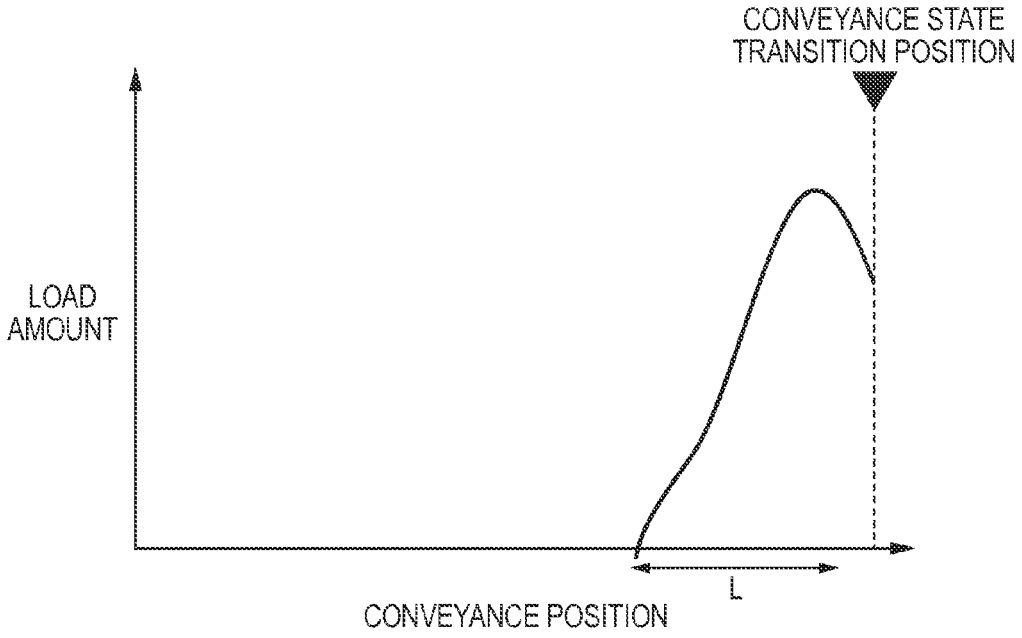

A load Fa is calculated. When the conveyance state transition position is located after the conveyance position I, the load amount then always exhibits the periodicity. For this reason, the calculation can be omitted. That is, the calculation starts before the conveyance state transition position by a conveyance change convergence distance L necessary for the load amount change to obtain a predetermined value at the conveyance state transition position (FIG. 10B). In this case, the load amount applied to the discharge roller 6 at the calculation start point is virtually set to 0 for the calculation.

As for the conveyance change convergence distance L, for example, calculation is performed first using the average conveyance amount of the main conveyance roller 2 and the discharge roller 6 except the periodical fluctuation caused by decentering. The conveyance change convergence distance L can be calculated by counting the calculation repeat count up to a threshold (second conveyance state, a change rate of 0.1%) at which the load amount change is determined to be eliminated.

A conveyance amount correction method in an actual printing operation will be described next. Assume that a conveyance amount $D_{LFm}$ of the main conveyance roller 2, a conveyance amount $D_{EJm}$ of the discharge roller 6, and the conveyance change convergence distance L are already obtained. Only parts different from the first embodiment will be explained.

Figure 11:
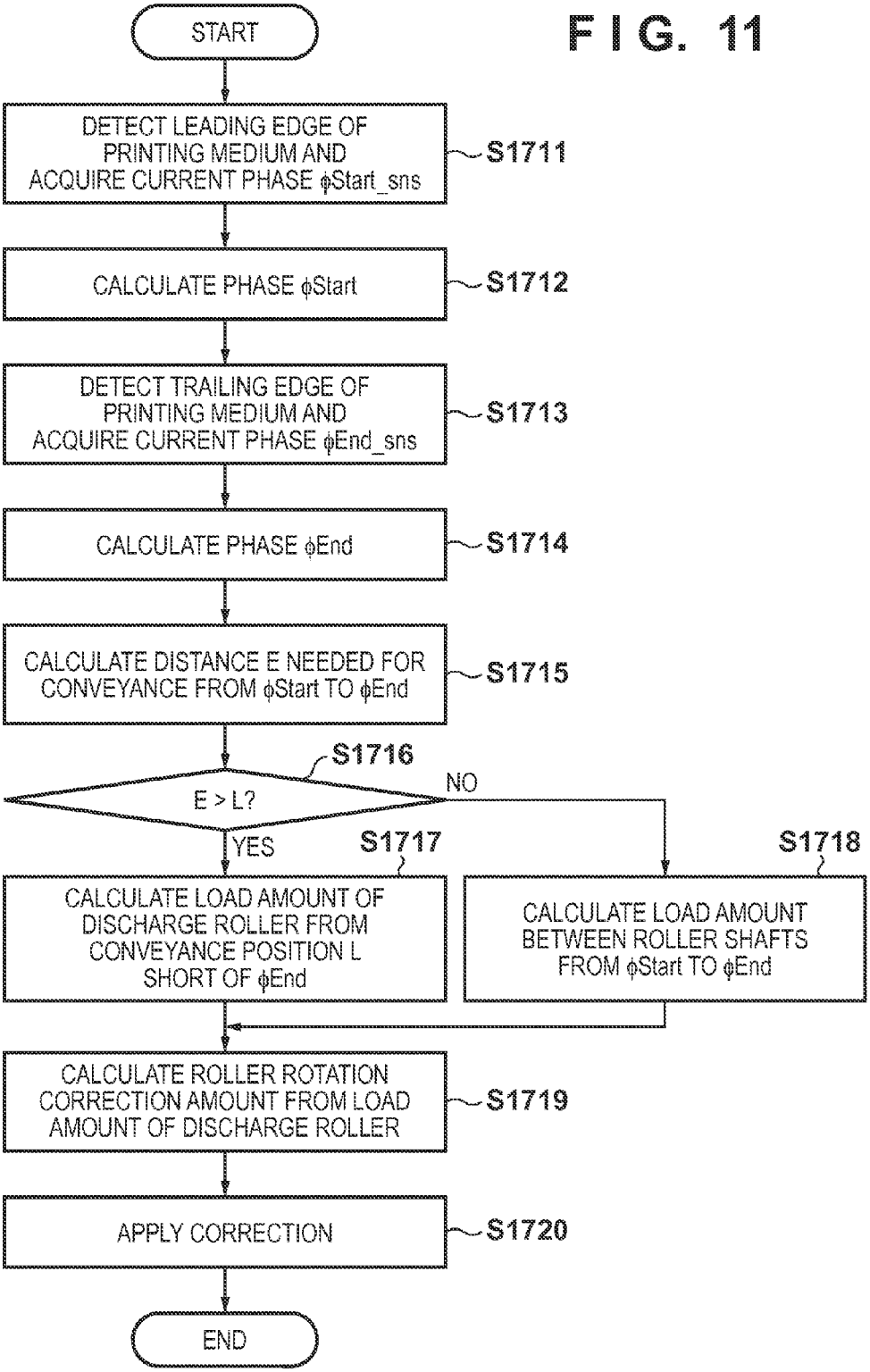
FIG. 11 is a flowchart of control at the time of printing according to the second embodiment.

FIG. 11 illustrates the control procedure in the actual printing operation according to this embodiment. FIG. 12 is a view for explaining repetitive calculation performed for the respective rotational phase intervals when omitting calculation.

The procedure up to step S1714 of FIG. 11 is the same that up to step S1704 of the first embodiment, and the procedure from step S1715 will be described.

When the trailing edge of the printing medium reaches a detecting lever 80, and a start phase ϕStart and ϕEnd of the second conveyance state are determined, a conveyance distance E from ϕStart to ϕEnd is calculated in step S1715. This can be implemented by causing an encoder sensor 20 to count the slits of a code wheel 19.

In step S1716, the magnitude relationship between the conveyance distance E and the conveyance change convergence distance L is determined. If the conveyance distance E is longer than the conveyance change convergence distance L, the process advances to step S1717. On the other hand, if the conveyance distance E is equal to or shorter than the conveyance change convergence distance L, the process advances to step S1718 to execute the same calculation as the contents described in the first embodiment.

In step S1717, the section from a point the distance L short of the printing medium transfer position up to the rotational phase ϕEnd at which transition of the conveyance state occurs is calculated thereby calculating the load amount (to be referred to as Fa') of the discharge roller 6 at the time of transition of the conveyance state (FIG. 12).

The start point of the repetitive calculation in step S1717 is located L short of the rotational phase position ϕEnd. In this embodiment, assume that conveyance position 8 is the start point. Once the start point is decided, the subsequent calculation is basically the same as in the first embodiment. The conveyance amounts of the rollers at the calculation start point, that is, conveyance position 8 in FIG. 12 are $D_{LF5}$ and $D_{EJ5}$, respectively, as in FIG. 9 of the first embodiment.

Since the load amount at conveyance position 8 is virtually set to 0, as described above, $F_1$ is 0. At conveyance position 9, since the roller phase advances by one step, the conveyance amounts of the rollers are $D_{LF6}$ and $D_{EJ6}$, respectively. A roller load amount $F_2$ at conveyance position 9 is calculated as follows in accordance with equation (6). That is, the load amount is calculated by substituting the load amount ($F_1$) and the conveyance amounts ($D_{LF5}$ and $D_{EJ5}$) of the rollers at the immediately preceding conveyance position into equation (6). In the above-described way, substitution of phase interval conveyance amounts corresponding to each conveyance position and calculation of the load amount applied to the discharge roller 6 are sequentially executed up to the position corresponding to ϕEnd, thereby calculating the load amount Fa'.

Step S1719 after the load amount applied to the discharge roller 6 has been calculated in step S1717 or S1718 is the same as in the first embodiment. The correction amount is calculated based on the load amount Fa', and the rotation amounts (control amounts) of the rollers are corrected.

As described above, in this embodiment, when calculating the load amount applied to the discharge roller 6, the calculation is omitted under a specific condition, thereby saving the calculation time.

Third Embodiment

In the first embodiment, to cope with a conveyance amount fluctuation upon switching the conveyance state, the conveyance amount fluctuation is canceled. Instead, the image printing timing may be controlled to suppress a shift of the printing position caused by the conveyance amount fluctuation at the time of conveyance state transition to the second conveyance state. An example of coping with the conveyance amount fluctuation based on the image printing timing will be described below while exemplifying a line-type printing apparatus.

A line-type printing apparatus simultaneously performs conveyance and image printing using a line-type printhead including printing nozzles arranged in the sheet width direction, unlike a serial printing apparatus. The characteristic features of the line-type printing apparatus will be explained first.

In all printing apparatuses including the line-type printing apparatus, the printhead needs to always exist at an ideal conveyance position at the timing when the printhead discharges ink. In a printing apparatus that alternately executes conveyance and printing, like the printing apparatus A of the first embodiment, the conveyance amount is corrected such that the printing medium stops at the ideal conveyance position before the printing operation.

In the line-type printing apparatus, however, since image printing is performed during conveyance, correction needs to be executed at a very early timing when the printhead discharges ink. In such a printing apparatus, it is more effective to correct the image printing timing of the printhead than to correct the conveyance amount of the printing medium.

Note that when the image printing timing is corrected finely in synchronism with the discharge timing of the printhead, degradation in image quality can be avoided. Hence, more pieces of conveyance amount information of the printing medium are obtained by dividing the roller periphery more finely than ⅛ division as the above-described embodiments. In this embodiment, thousands pieces of conveyance amount information are obtained for the respective slit intervals of the code wheel.

When the number of pieces of conveyance amount information increases, it is often difficult to acquire the phase interval conveyance amounts by pattern printing described in the first embodiment. Instead, for example, a method of directly reading the conveyance amount of the printing medium using an optical sensor can be employed. As the optical sensor, a laser Doppler sensor or the like is used, and a known technique is usable for this.

In this embodiment, assume a form in which conveyance amount information is acquired in advance in the factory or the like using an optical sensor provided outside the printing apparatus and stored in the printing apparatus.

Figure 13:
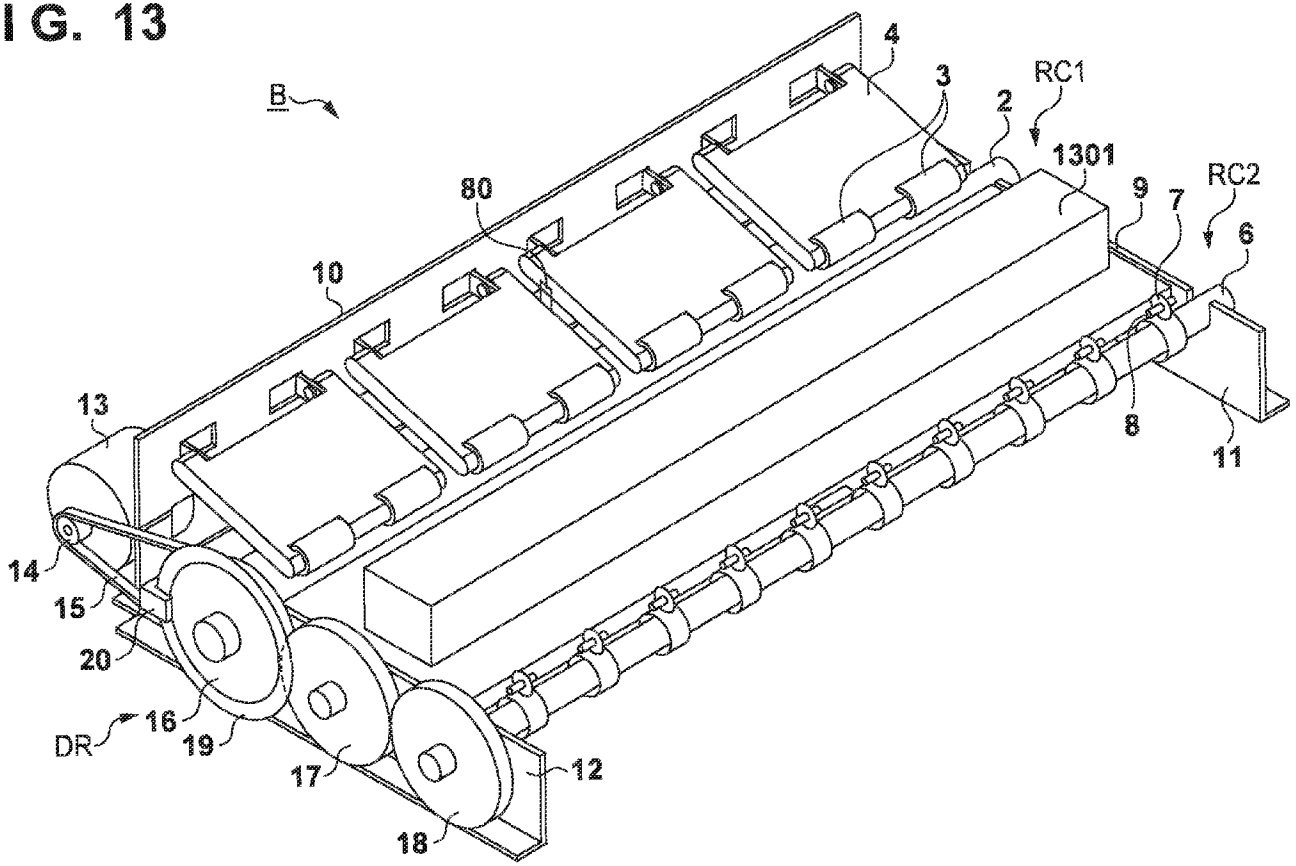
FIG. 13 is perspective view of the mechanism unit of a printing apparatus according to still another embodiment.

FIG. 13 is perspective view of the mechanism unit of a printing apparatus B according to this embodiment. As shown in FIG. 13, a printhead 1301 is designed to cover the whole sheet width. The remaining mechanism units are the same as in the printing apparatus A of the first embodiment. Hence, the same reference numerals denote the same parts, and a description thereof will be omitted.

FIG. 14 is a view showing a table that stores phase interval conveyance amounts D of a main conveyance roller 2 and a discharge roller 6 according to this embodiment.

The concept of the method of acquiring the phase interval conveyance amounts D in the first and third conveyance states is basically the same as in the first embodiment except that instead of acquiring the conveyance amounts by printing test patterns as in the first embodiment, the conveyance amounts are acquired for each slit of a code wheel 19 during printing medium conveyance using an optical sensor provided outside the printing apparatus.

In this embodiment, the code wheel 19 is assumed to have 2,000 slits. The number of predetermined phase intervals is 2,000, that is, equals the number of slits. FIG. 14 shows the rotational phase interval conveyance amounts D acquired in the first and third conveyance states according to this embodiment.

Figure 15:
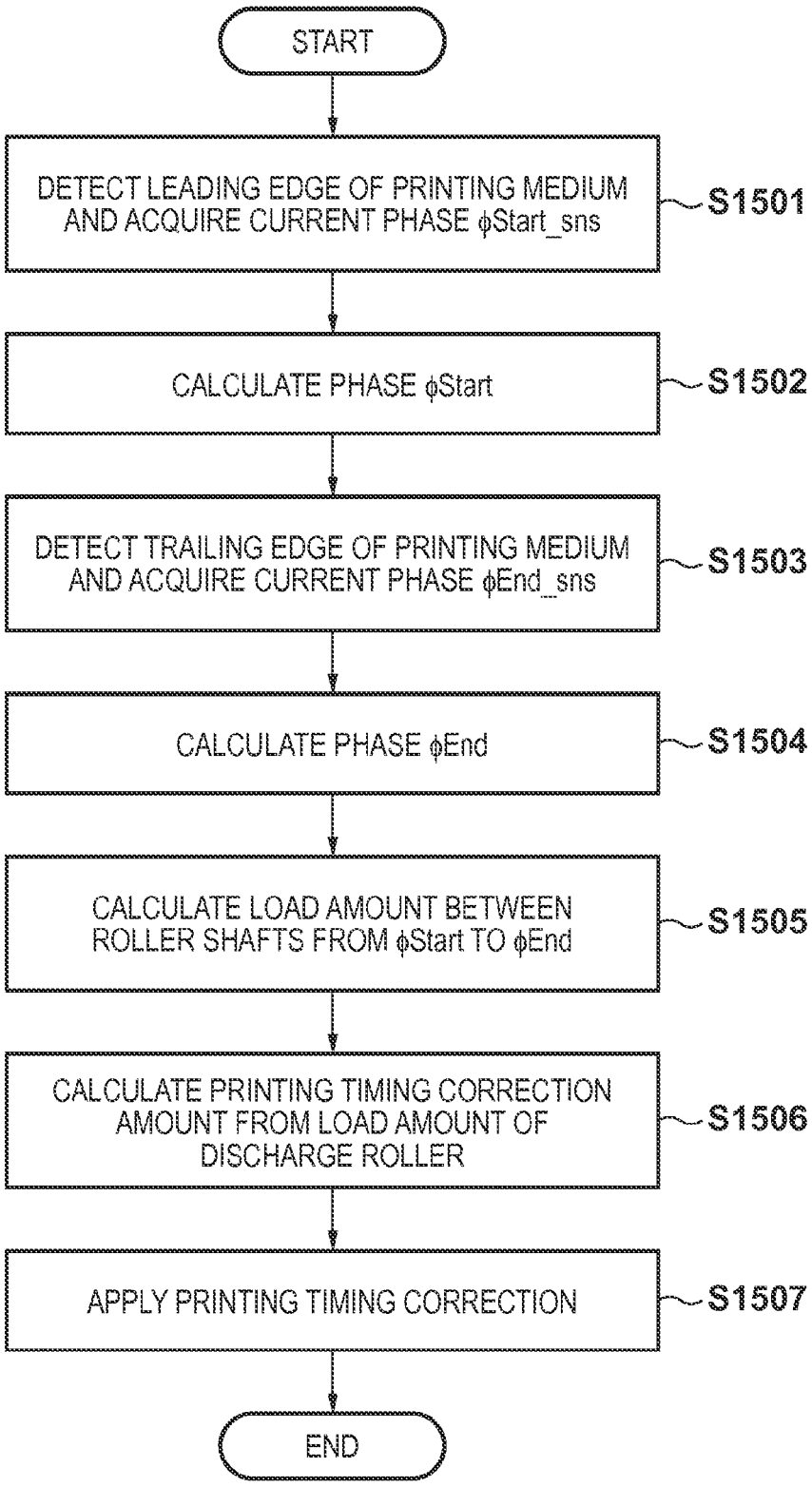
FIG. 15 is a flowchart of control at the time of printing in the printing apparatus shown in FIGS. 10A and 10B.

An image printing timing correction method upon switching from the first conveyance state to the second conveyance state in the actual printing operation will be described next. FIG. 15 illustrates the correction control procedure in the actual printing operation.

The control procedure is also basically the same as in the first and second embodiments except that the correction target is not the rotation amount of the roller but the image printing timing. That is, the processing up to step S1504 is the same as in the first and second embodiments. The processing from step S1506 in which the correction value of the printing timing is calculated will be described here assuming that the load amount of the discharge roller 6 has already been calculated.

In step S1506, using the load amount of the discharge roller 6 calculated in the previous step S1505, the correction value of the printing timing at the time of transition from the second conveyance state to the third conveyance state is calculated.

First, as in the first embodiment, a correction value Z is calculated using equations (7) and (8) from the load amount calculated in the previous step S1505. Next, a printing timing correction value δt is calculated by equation (10) of FIG. 16 using the correction value Z, where V is the ideal conveyance speed of the printing medium.

After the calculation of the printing timing correction value δt, the printing timing is corrected at the time of transition of the conveyance state in step S1507, and image printing is performed.

As described above, the fluctuation in the conveyance amount upon switching the conveyance state is coped with correction of the image printing timing, thereby avoiding degradation in image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2012-203542, filed Sep. 14, 2012, which is hereby incorporated by reference herein in its entirety.

What is claimed is:

1. A printing apparatus comprising:

a printhead that prints an image on a printing medium;

a first conveyance roller that is provided on an upstream side of said printhead along a conveyance direction of a printing medium and conveys a printing medium;

a second conveyance roller that is provided on a downstream side of said printhead along the conveyance direction and conveys a printing medium;

a conveyance control unit configured to perform a conveyance control for changing a conveyance state from a first conveyance state in which the first conveyance roller conveys a printing medium and the second conveyance roller does not convey the printing medium, to a second conveyance state in which the first conveyance roller and the second conveyance roller convey the printing medium, and then to a third conveyance state in which the first conveyance roller does not convey the printing medium and the second conveyance roller conveys the printing medium;

a calculating unit configured to calculate a load mutually acting on said first conveyance roller and said second conveyance roller through the printing medium in the second conveyance state; and a correcting unit configured to correct, a conveyance amount when the conveyance state is changed from the second conveyance state to the third conveyance state based on a calculation result of the load.

2. The apparatus according to claim 1, further comprising a storage unit configured to store conveyance amount information associated with a conveyance amount for a predetermined conveyance unit of each of said first conveyance roller and said second conveyance roller, wherein said calculating unit calculates the load based on the conveyance amount information.

3. The apparatus according to claim 2, wherein said storage unit stores a conveyance characteristic coefficient associated with a conveyance change amount with respect to the load of each of said first conveyance roller and said second conveyance roller, and a rigidity coefficient associated with a displacement amount with respect to the load of each of said first conveyance roller and said second conveyance roller, and said control unit calculates the load based on the conveyance amount information, the conveyance characteristic coefficient, and the rigidity coefficient.

4. The apparatus according to claim 1, wherein said calculating unit calculates the load from a midstream of the second conveyance state up to the time changing from the second conveyance state to the third conveyance state.

5. The apparatus according to claim 2, wherein the conveyance amount information is set based on a measurement value of an actual conveyance amount of the printing medium in the first conveyance state and the measurement value of the actual conveyance amount of the printing medium in the third conveyance state, based on the measurement value of the actual conveyance amount of the printing medium in the first conveyance state and the measurement value of the actual conveyance amount of the printing medium in the second conveyance state, or based on the measurement value of the actual conveyance amount of the printing medium in the third conveyance state and the measurement value of the actual conveyance amount of the printing medium in the second conveyance state.

6. The apparatus according to claim 1, further comprising a detection unit configured to detect a conveyance position of the printing medium, wherein said control unit performs the conveyance control based on a detect result of said detection unit.

7. The apparatus according to claim 1, wherein the printing apparatus comprises a serial printing apparatus configured to form the image by scanning said printhead in a direction perpendicular to the conveyance direction of the printing medium.

8. The apparatus according to claim 1, wherein the printing apparatus comprises a line-type printing apparatus, and said printhead comprises a line-type printhead including printing nozzles arranged in a direction perpendicular to the conveyance direction of the printing medium.

9. The apparatus according to claim 2, further comprising a first rotation member configured to rotate in accordance with said first conveyance roller, and a second rotation member configured to rotate in accordance with said conveyance roller, wherein the printing medium is conveyed while being sandwiched between said first conveyance roller and said first rotation member and/or between said second conveyance roller and said second rotation member, and the predetermined conveyance unit is a rotation angle of each of said first conveyance roller and said second conveyance roller.

10. A method of controlling a printing apparatus including:

a printhead that prints an image on a printing medium;

a first conveyance roller that is provided on an upstream side of the printhead along a conveyance direction of a printing medium and conveys a printing medium; and a second conveyance roller that is provided on a downstream side of the printhead along the conveyance direction and conveys a printing medium; the method comprising:

performing a conveyance control for changing a conveyance state from a first conveyance state in which the first conveyance roller conveys a printing medium and the second conveyance roller does not convey the printing medium, to a second conveyance state in which the first conveyance roller and the second conveyance roller convey the printing medium, and then to a third conveyance state in which the first conveyance roller does not convey the printing medium and the second conveyance roller conveys the printing medium;

calculating a load mutually acting on the first conveyance roller and the second conveyance roller through a printing medium in the second conveyance state; and correcting a conveyance amount when the conveyance state is changed from the second conveyance state to the third conveyance state based on a calculation result of the load.

11. The apparatus according to claim 1, wherein said calculating unit calculates the load during the second conveyance state.

12. The apparatus according to claim 1, wherein said calculating unit recursively calculates the load for a predetermined conveyance unit while setting an initial value to 0.

* * * * *